US005215060A

United States Patent [19]

Klopfer et al.

[11] Patent Number: 5,215,060

[45] Date of Patent: Jun. 1, 1993

[54] FUEL SYSTEM FOR ROTARY DISTRIBUTOR FUEL INJECTION PUMP

[75] Inventors: Kenneth H. Klopfer, East Hartland; William W. Kelly, Granby, both of Conn.

[73] Assignee: Stanadyne Automotive Corp., Windsor, Conn.

[21] Appl. No.: 730,676

[22] Filed: Jul. 16, 1991

[51] Int. Cl.[5] ..... F02M 41/00

[52] U.S. Cl. ..... 123/450; 123/387

[58] Field of Search ..... 123/450, 506, 387, 467, 123/447, 385-386

[56] References Cited

U.S. PATENT DOCUMENTS

| | | | |
|---|---|---|---|
| 4,201,170 | 5/1980 | Overfield . | |
| 4,246,876 | 1/1981 | Bouwkamp et al. . | |
| 4,331,119 | 5/1982 | Chadwick | 123/450 |
| 4,336,781 | 6/1982 | Overfield . | |
| 4,393,844 | 7/1983 | Skinner | 123/450 |
| 4,512,308 | 4/1985 | Hofer | 123/387 |
| 4,541,385 | 9/1985 | Eheim | 123/450 |
| 4,574,759 | 3/1986 | Leblanc | 123/450 |
| 4,625,694 | 12/1986 | Adey | 123/450 |
| 4,770,141 | 9/1988 | Bonin | 123/387 |
| 4,840,162 | 6/1989 | Brunel | 123/450 |
| 4,884,549 | 12/1989 | Kelly . | |
| 4,913,632 | 4/1990 | Thornwaite | 123/387 |
| 4,915,592 | 4/1990 | Hishinuma et al. . | |
| 4,971,012 | 11/1990 | Brunmel | 123/387 |
| 5,012,785 | 5/1991 | Long et al. . | |

*Primary Examiner*—Carl S. Miller

*Attorney, Agent, or Firm*—Chilton, Alix & Van Kirk

[57] ABSTRACT

A rotary distributor fuel injection pump having a fuel system for circulating fuel continuously from a fuel supply pump via an end chamber at one end of the distributor rotor and an annular fuel chamber surrounding the distributor rotor to a return line and a pressure regulator in the return line for regulating the upstream pressure and continuously returning excess fuel to the supply pump. An electrical control valve is selectively opened during the pumping strokes to spill fuel into the end chamber and terminate the fuel injection event. An auxiliary passage in the rotor resets the pressure in the distributor outlets to approximately the same initial pressure. In an air purging mode of operation, the control valve is held closed until after the distributor port moves out of registry with each distributor outlet to prevent back flow to the end chamber. A retraction shuttle valve in each distributor outlet employs a short closure spring which permits the retraction shuttle to float freely in an unloaded spring gap to equalize the upstream and downstream pressures.

31 Claims, 7 Drawing Sheets

FUEL SYSTEM FOR ROTARY DISTRIBUTOR FUEL INJECTION PUMP

SUMMARY OF THE INVENTION

The present invention relates generally to rotary distributor fuel injection pumps of the type having reciprocating pumping means with periodic intake and pumping strokes for delivering a charge of fuel at high pressure for fuel injection, a rotary distributor for distributing the high pressure charges of fuel to a plurality of distributor outlets and a control valve for spill termination of each high pressure charge.

It is a principal aim of the present invention to provide in a fuel injection pump of the type described, a fuel system having one or more of the following: (a) new and improved system for supplying fuel from a fuel supply pump to the reciprocating pumping means; (b) new and improved system for returning spilled fuel to the supply pump inlet; (c) new and improved system for preventing thermal shock to the distributor rotor; (d) new and improved system for resetting the pressure in the distributor outlets to approximately the same initial pressure to minimize or eliminate shot-to-shot variations in the injected quantity; (e) new and improved system for reducing cavitation erosion at the critical areas of the valve; (f) new and improved system for expelling air from the distributor outlets; and (g) new and improved system to maintain the fuel supply pressure at a level which ensures adequate supply of fuel to the pumping means during each intake stroke and prevent excessive back pressure during the spill phase of each pumping stroke.

It is another aim of the present invention to provide in a rotary distributor fuel injection pump of the type described, a new and improved fuel system for circulating fuel continuously from the supply pump inlet to the supply pump outlet for removing hot spilled fuel and preventing thermal shock to the rotary distributor.

It is a further aim of the present invention to provide one or more of the foregoing improvements in a rotary distributor fuel injection pump of the type described which is otherwise of generally conventional design.

It is a further aim of the present invention to provide in a rotary distributor fuel injection pump of the type described, a new and improved fuel system which extends the life of the pump.

Other objects will be in part obvious and in part pointed out more in detail hereinafter.

A better understanding of the invention will be obtained from the following detailed description and the accompanying drawings of illustrative applications of the invention.

DESCRIPTION OF PREFERRED EMBODIMENTS

Figure 1:
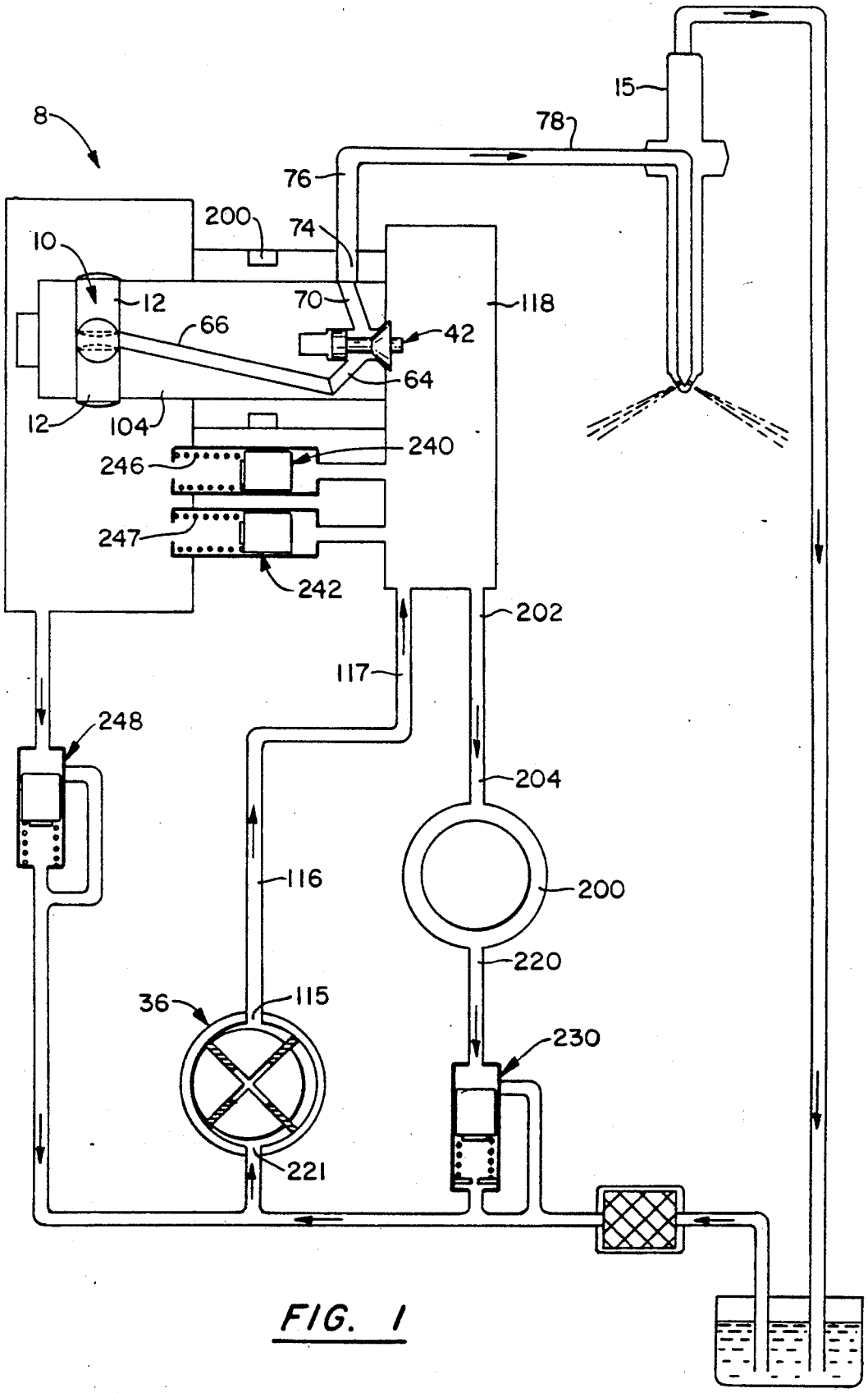
FIG. 1 is a diagrammatic illustration of a rotary distributor fuel injection pump incorporating a first embodiment of a fuel system of the present invention.
Figure 2:
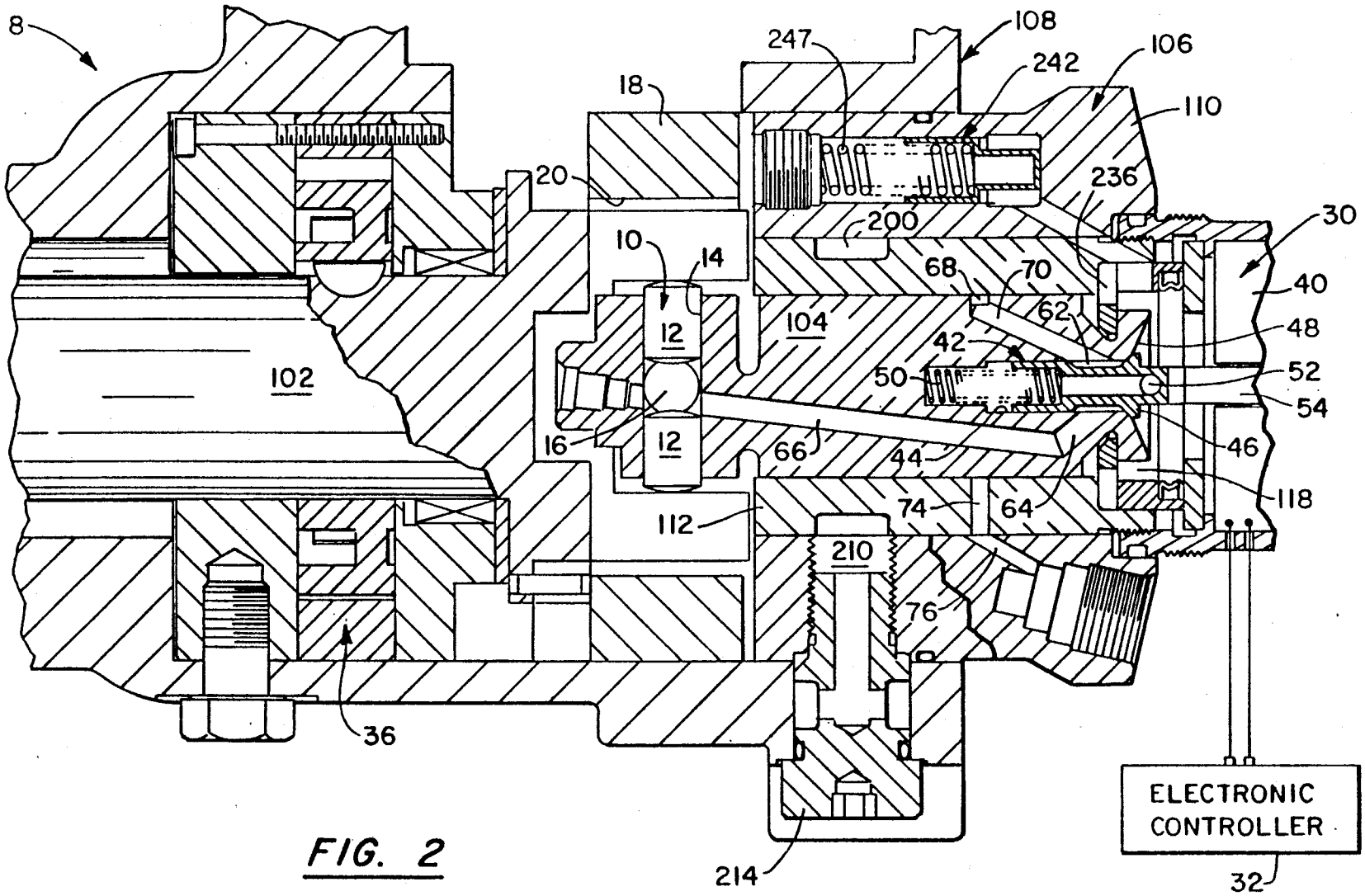
FIG. 2 is a longitudinal section view, partly broken away and partly in section, of the fuel injection pump, additionally diagrammatically showing an electronic controller for operating a solenoid control valve of the pump.
Figure 4:
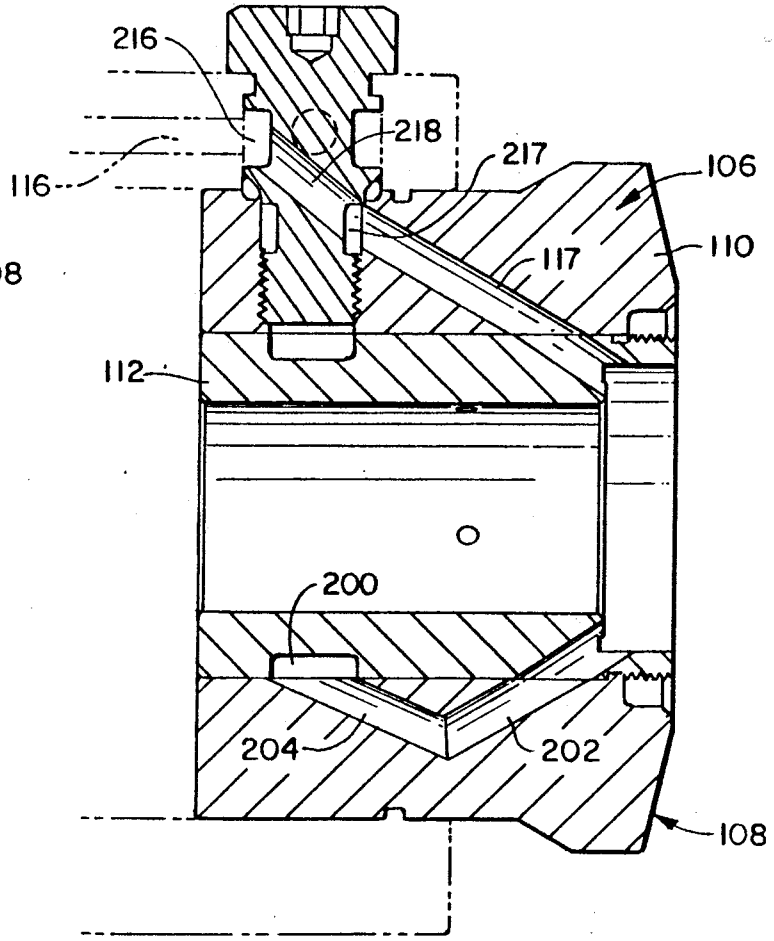
FIG. 4 is a longitudinal section view, partly broken away and partly in section, showing a hydraulic head of the pump housing in full lines and other portions of the pump housing in broken lines.
Figure 3:
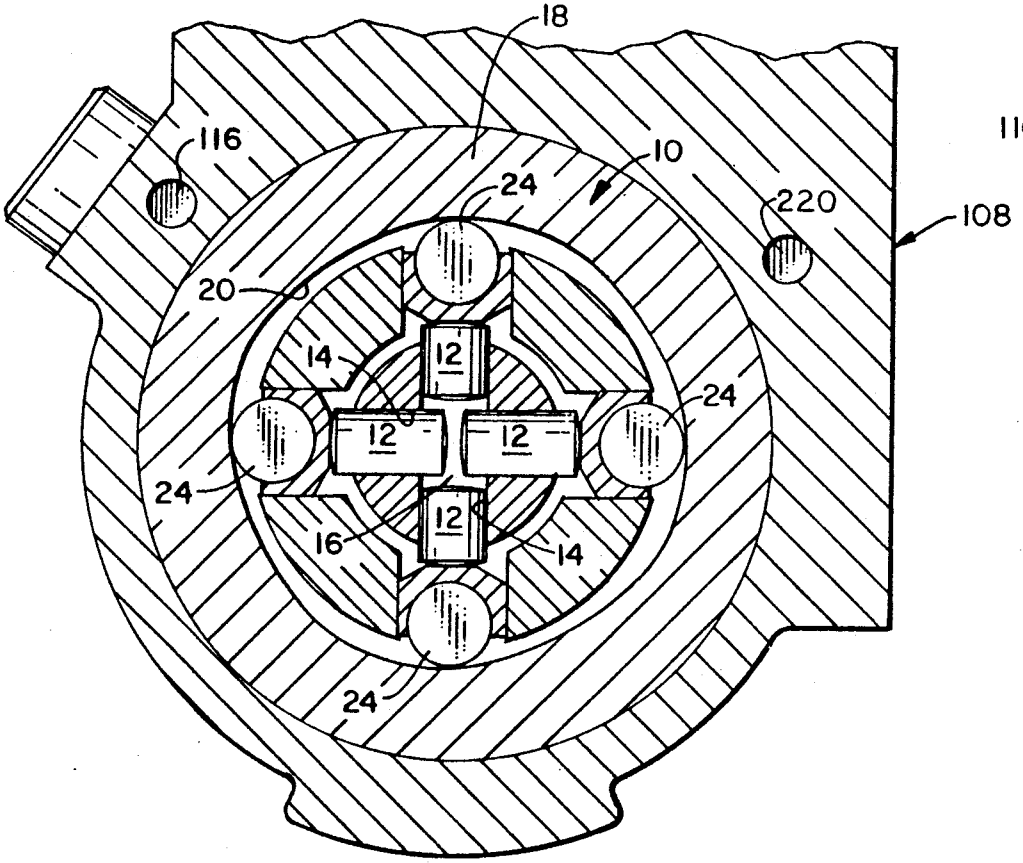
FIG. 3 is a transverse section view, partly broken away and partly in section, of the fuel injection pump.

In the drawings, the same numerals are used to identify the same or like functioning parts or components. The fuel system of the present invention has notable utility with rotary distributor fuel injection pumps of the type having a control valve for spill termination of the delivery of each high pressure charge. Included are such pumps having a pump-spill mode of operation. Also, included are such pumps having a fill-spill mode of operation of the kind described in U.S. Pat. No. 4,884,549, dated Dec. 5, 1989 and entitled "Method And Apparatus For Regulating Fuel Injection Timing And Quantity".

FIGS. 1 through 8 show an exemplary rotary distributor fuel injection pump 8 which incorporates an embodiment of the fuel system. Except as otherwise described herein, the exemplary pump 8 may be like the rotary distributor fuel injection pump disclosed in U.S. Pat. No. 4,884,549. Therefore, U.S. Pat. No. 4,884,549, which is incorporated herein by reference, should be referred to for details not disclosed herein.

The exemplary pump 8 is designed for use with a four cylinder engine. In a conventional manner, the pump 8 has a reciprocating, positive displacement charge pump 10. A rotor 104 of the charge pump 10 forms part of a pump drive shaft 102 driven by the associated engine at one-half engine speed. The rotor 104 is mounted in a hydraulic head 106 which forms part of a pump housing 108. The hydraulic head 106 comprises an outer body or barrel 110 and an inner rotor support sleeve 112. The charge pump 10 has four equiangularly spaced pumping plungers 12 mounted for reciprocation within two diametral bores 14 for pumping fuel from a central pumping chamber 16 formed between the plungers 12. A cam ring 18 encircling the rotor 104 has an internal cam 20 with four equiangularly spaced cam lobes engageable by plunger actuating rollers 24 for periodically camming the plungers 12 inwardly together during rotation of the rotor 104. The cam ring 18 is fixed to provide fixed charge pump stroke timing. If desired, the cam ring 18 may be made angularly adjustable to adjust the charge pump stroke timing, for example, as disclosed in U.S. Pat. No. 4,476,837, dated Oct. 16, 1984 and entitled "Method And System For Fuel Injection Timing".

A bidirectional flow, electrical control valve 30 supplies fuel to the charge pump 10 during the outward intake stroke of the plungers 12. The control valve 30 is closed before the completion of the intake stroke by energizing a valve solenoid 40. The valve 30 remains closed during the remainder of the intake stroke and during an initial phase of the following inward pumping stroke of the plungers 12. During that initial phase, any fuel vapor or cavitation pockets in the delivery line in the rotor 104 are first eliminated and then a charge of fuel is delivered at high pressure for fuel injection. The valve solenoid 40 is normally deenergized before the end of the pumping stroke to open the control valve 30 and thereby spill terminate the fuel injection event. The operation of the solenoid 40 is regulated by a suitable electronic controller 32.

A fuel chamber 118 is provided at the outer end of the rotor 104 to supply fuel to the charge pump 10 during the intake stroke and to receive spilled fuel from the charge pump 10 during the pumping stroke. Fuel is supplied to the end chamber 118 by a positive displacement, vane type, transfer or supply pump 36 mounted on and driven by the pump drive shaft 102. The transfer pump 36 supplies fuel to the end chamber 118 via drilled passages 116, 117 in the pump housing 108.

The control valve 30 has a poppet type, linear valve member 42 mounted within a coaxial bore 44 in the outer end of the rotor 104. The poppet valve 42 has a conical head 46 engageable with a conical valve seat 48 at the outer end of the bore 44. A coil compression spring 50 and a slight, unbalanced hydraulic opening force on the poppet valve 42 open the poppet valve 42 when the valve solenoid 40 is deenergized. Diametral and axial bores 52 are provided in the poppet valve 42 to assist in equalizing the fuel pressures at the opposite ends of the valve 42.

The solenoid 40 is mounted on the hydraulic head 106 with its armature pin 54 coaxially aligned with the poppet valve 42. The armature pin 54 engages the outer end face of the poppet valve 42 which is rounded slightly to facilitate relative rotation of the poppet valve 42 and armature pin 54. The poppet valve 42 and armature pin 54 shift axially together upon energization and deenergization of the solenoid 40.

The poppet valve stem has a peripheral annulus 62 for connecting the end chamber 118 to the charge pump 10 when the poppet valve 42 is open. The annulus 62 extends inwardly from the conical head 46 to minimize required poppet valve movement to open the control valve 30. During each intake stroke, fuel is delivered from the end chamber 118 to the pumping chamber 16 via the annulus 62 and two serially connected diagonal bores 64, 66 in the rotor 104. During each pumping stroke, before the control valve 30 is opened, fuel is delivered at high pressure via a delivery line in the rotor 104 having a diagonal distributor bore 70 leading from the annulus 62. After the valve 30 is opened, the fuel delivered by the charge pump 10 is spilled into the end chamber 118 via bores 66, 64 and valve annulus 62. Also, after the valve 30 is opened, the distributor bore 70 remains connected to the annulus 62 (and via the annulus 62 to the pumping chamber 16 and end chamber 18) to permit reverse flow from the distributor bore to the pumping chamber 16 and end chamber 18.

A distributor port 68 at the outer end of the distributor bore 70 registers sequentially with four equiangularly spaced outlet ports 74 for delivering the high pressure fuel sequentially to the four engine injectors 15. Each outlet port 74 is connected to an injector 15 via a drilled outlet passage 76 in the hydraulic head 106 and a high pressure line 78. Thus, the rotor 104 and head 106 provide a rotary distributor for distributing the high pressure fuel to the four engine injectors 15. The dead volume of the annulus 62 and diagonal bores 64, 66, 710 in the distributor rotor 104 is held to a minimum to permit fuel injection up to 12,000 psi or higher.

Thus, fuel is supplied to and spilled from the charge pump 10 via the valve annulus 62. Also, each high pressure pulse is delivered to the distributor head 106 via the valve annulus 62. It has been found that by delivering the high pressure pulses through the valve annulus 62, the formation of fuel vapor or cavitation pockets within the valve annulus 62 is substantially reduced or eliminated. Otherwise, cavitation erosion, due to the collapse of vapor pockets in the valve annulus 62, occurs at critical areas of the valve, including the cooperating areas of the poppet valve head 46 and valve seat 48. In addition, the described flow through valve system substantially reduces or eliminates pressure wave reflection from the walls of the annulus 62. Since a pressure wave doubles in magnitude when reflected from the dead end of a closed passage, cavitation erosion at the critical areas of the poppet valve 42 is thereby prevented or minimized.

Figure 6:
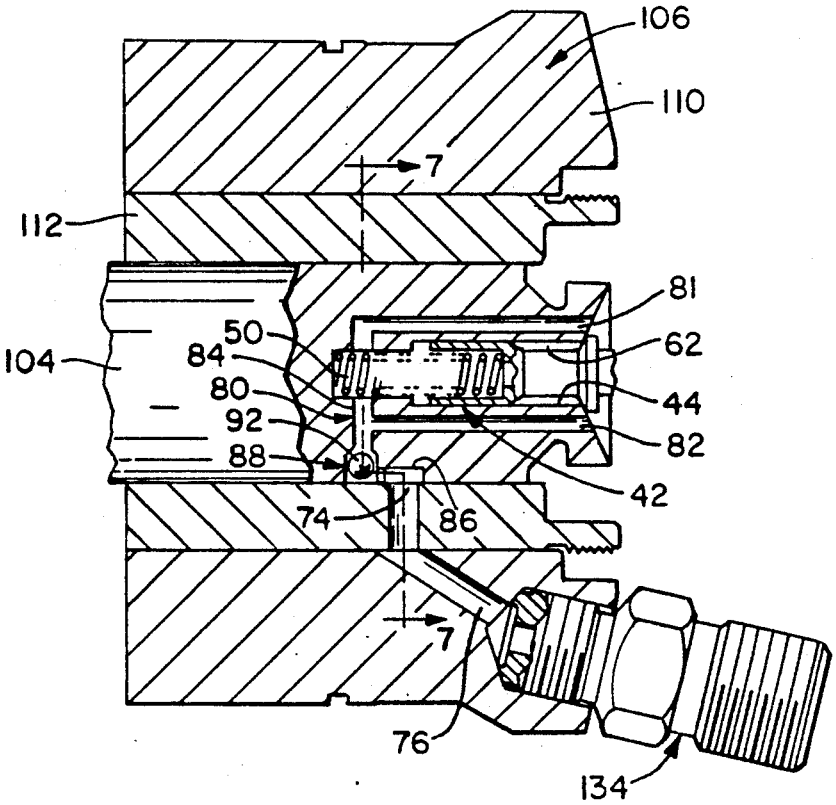
FIG. 6 is a longitudinal section view, partly broken away and partly in section, of the fuel injection pump, showing a line pressure conditioning system of the pump.
Figure 7:
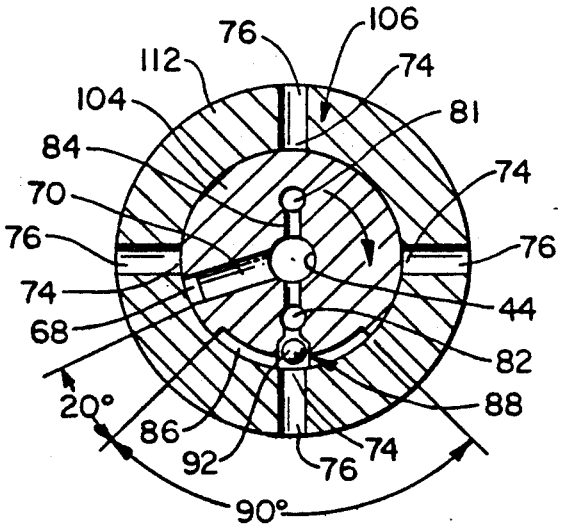
FIG. 7 is a transverse section view, partly in section, taken generally along line 7—7 of FIG. 6.

Referring to FIGS. 6 and 7, an auxiliary passage 80 is provided in the rotor 104 for connecting the end chamber 118 sequentially to the distributor outlet passages 76. The auxiliary passage 80 is provided by two parallel axial bores 81, 82 leading from the end chamber 118, one radial bore 84 and an auxiliary port 86. The radial bore 84 is connected to the inner ends of the axial bores 81, 82. The radial bore 84 intersects the inner end of the poppet valve bore 44 to assist in equalizing the fuel pressures at the opposite ends of the poppet valve 42. The auxiliary port 86 is provided by a circumferential groove which extends 90° in the shown embodiment. The radial bore 84 is preferably angularly located approximately halfway between the ends of the peripheral groove 86. The leading end of the groove 86 is spaced from the distributor port 68 to provide a 20° sealing land therebetween. Thus, the auxiliary port 86 rotates into registry with each outlet port 74 approximately 20° after the distributor port 68 rotates out of registry with the outlet port 74. Accordingly, after a high pressure charge is delivered to each outlet passage 76, the outlet passage 76 is connected via the auxiliary passage 80 to the end chamber 118. The pressure in each outlet line 78 is thereby preconditioned or reset to approximately the same initial pressure before the next high pressure charge is delivered to the outlet line 78. The circumferential groove 86 may be lengthened to up to 270° where the additional conditioning time is beneficial. Shot-to-shot variations in the injected quantity due to variations in the initial line pressure are thereby minimized or eliminated.

A one-way ball check valve 88 is provided in the radial bore 84 to prevent excessive back flow to the end chamber 118. An outwardly facing ball seat of the check valve 88 is provided at the outer end of the radial bore 84. A ball 92 mounted for engagement with the seat is lifted radially outwardly from the seat by centrifugal force and downstream fuel flow. In the open position of the check valve 88, the ball 92 normally rides on the inner cylindrical surface of the distributor head 106. A slight radial clearance is provided between the lifted ball 92 and bore 84 for fuel flow. The check valve 88 permits limited back flow to the end chamber 118 as the ball reseats to reset the outlet line pressure as described. However, excessive back flow, caused by air in the outlet lines 78, is prevented by the closed valve 88. Once closed, the check valve 88 is held closed by any air in the succeeding outlet lines 78 as the auxiliary port 86 rotates into registry with the outlet ports 74. After a few cycles, all of the air in the outlet lines 78 is expelled through the injectors 15.

Expulsion of air from the outlet lines 78 is facilitated by maintaining the control valve 30 closed at the end of each pumping stroke until after the distributor port 68 rotates out of registry with each outlet port 74 (and also therefore after the completion of the pumping stroke). The valve 30 is then opened (during the intake stroke) to supply fuel to the charge pump 10 in the normal manner. This delayed valve opening mode of operation prevents back flow through the distributor port 68 and valve 30 to the end chamber 118. Also, any additional fuel delivered to the outlet lines 78 assists in expelling air from the lines 78. This air purging mode of operation is automatically performed by the electronic controller 32 for a predetermined interval (a) when the engine is started the first time after installation of the pump 8 and (b) after a predetermined number of engine revolutions during engine cranking if the engine has not reached a predetermined idle RPM.

Figure 8:
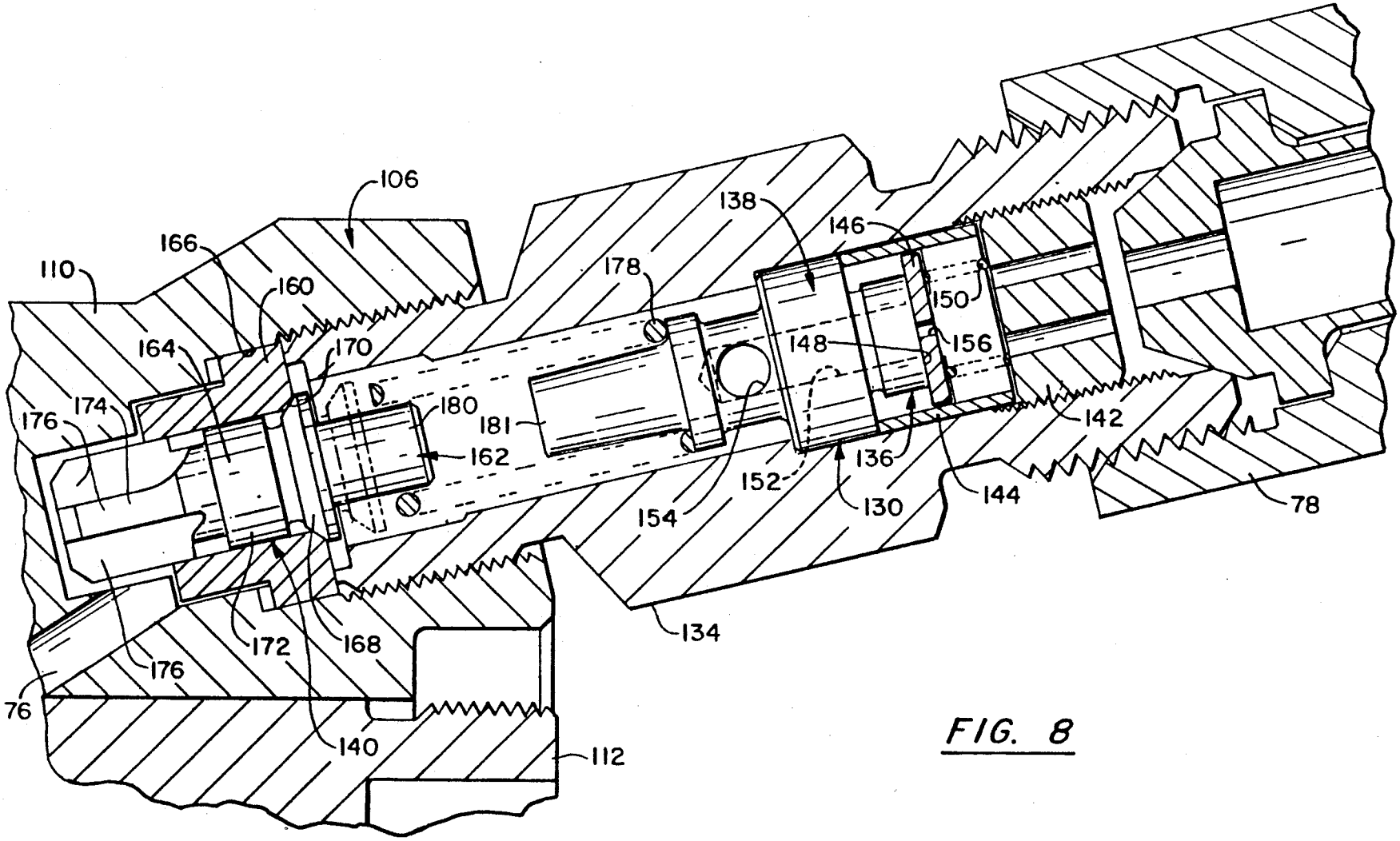
FIG. 8 is an enlarged longitudinal section view, partly broken away and partly in section, of the fuel injection pump, showing a combined snubber and shuttle valve of the pump.

Referring to FIG. 8, a dual purpose valve 130 may be provided in each outlet line 78 to assist in controlling the line pressure between fuel injection events and to prevent undesirable secondary fuel injection due to reflected high pressure waves. The dual purpose valve 130 is mounted in each outlet line connector 134 threaded into the distributor head barrel 110. The valve 130 comprises a conventional downstream snubber valve 136 and an upstream shuttle retraction valve 140. A fixed intermediate insert 138 forms part of each valve.

The snubber valve 136 is like that shown in U.S. Pat. No. 4,246,876, dated Jan. 27, 1981 and entitled "Fuel Injection System Snubber Valve Assembly". The snubber valve 136 includes an outer retainer 142 and an intermediate spacer sleeve 144. A snubber valve plate 146 is normally held against an outer flat end face 148 of the intermediate insert 138 by a coil Compression spring 150 interposed between the valve plate 146 and outer retainer 142. The intermediate insert 138 has a through passage provided by an axial bore 152, normally covered by the valve plate 146, and a diametral bore 154. The valve plate 146 is momentarily raised from its seat 148 by each high pressure pulse. As the pulse subsides, the valve plate 146 reengages the seat 148. A small central aperture 156 in the valve plate 146 serves to dampen the usual pressure waves reflected upstream from the injector 15 when the injector closes.

The shuttle retraction valve 140 comprises a fixed valve guide 160 and a retraction shuttle 162. The shuttle 162 has an elongated plunger valve 164 received within an axial bore 166 in the valve guide 16. An outer conical head 168 of the shuttle 162 engages a conical seat 170 at the outer end of the valve bore 166 to limit the inward movement of the shuttle 162. The plunger valve 164 has an outer, cylindrical, sealing plunger 172 and an inner, non-sealing plunger guide skirt 174 formed by four equiangularly spaced guides 176.

A short coil compression spring 178 is mounted on opposed coaxial projections 180, 181 of the shuttle 162 and intermediate insert 138. The opposed projections 180, 181 establish the outward limit position of the shuttle 162 and therefore the maximum shuttle stroke. The length of the short spring 178 is less than the distance between its opposed spring seats by a predetermined unloaded spring gap when the shuttle 162 is seated against the valve guide 160. The short spring 178 permits the shuttle 162 to float freely within the unloaded spring gap to equalize the pressures at the opposite ends of the shuttle 162. With the shuttle 162 floating in the unloaded spring gap, the sealing plunger 172 is received within the valve bore 166 to prevent fuel flow through the shuttle valve 140 in either direction. When a high pressure pulse is delivered to the outlet line 78, the shuttle 162 is actuated into engagement with the projection 181 to permit fuel flow through the shuttle valve 140 between the guides 176 of the skirt 174. When the high pressure pulse subsides, the shuttle 162 is retracted by the return spring 178 and by the higher downstream pressure to equalize the upstream and downstream pressures. The unloaded spring gap and shuttle stroke are established so that the shuttle 162 normally floats within the unloaded spring gap between fuel pulses. For example, the shuttle stroke is 0.050 inch and the unloaded spring gap is 0.030 inch and therefore slightly greater than one-half the shuttle stroke. Because the shuttle valve 140 also serves as a one-way check valve which prevents substantial back flow to the end chamber 118, the check valve 88 and described delayed valve opening mode of operation of valve 30 are unnecessary and therefore not employed when the shuttle valve 140 is employed.

The rotor support sleeve 112 has a peripheral annulus 200 providing an annular fuel chamber surrounding the rotor 104. The annulus 200 is axially located intermediate the charge pump 10 and distributor port 68 to conduct heat from approximately the middle of the hydraulic head 106 and thereby assist in maintaining the temperature of the hydraulic head 106 at approximately the same temperature as the rotor 104. Drilled diagonal bores 202, 204 (FIG. 4) in the hydraulic head 106 connect the end chamber 118 to the annulus 200. Thus, fuel is supplied by the transfer pump 36 to the annulus 200 via the end chamber 118.

The pump housing 108, including the hydraulic head 106, has three, 120° spaced, threaded radial bores 208–210 leading to the annulus 200. Threaded male connector plugs 212–214 are mounted in the three bores 208–210. One plug 213 has two axially spaced, peripheral grooves 216, 217, and an intermediate diagonal bore 218 to connect the drilled passages 116, 117 and thereby connect the end chamber 118 to the transfer pump outlet 115. A second plug 212 has a passage 219 for connecting the annulus 200 to a drilled passage 220 in the pump housing 108 which provides a return line for returning fuel to the transfer pump inlet 221. A third plug 214 is used to connect the annulus 200 to a cam operating piston, if provided, or to any other hydromechanical device of the pump 8.

Referring to FIG. 1, a pressure relief valve or regulator 230 is connected to the return line 220 and therefore between the annulus 200 and transfer pump inlet 221. The pressure regulator 230 returns excess fuel directly to the transfer pump inlet 221. In the alternative, the pressure regulator 230 may be connected to return excess fuel to the fuel tank before the fuel is returned to the transfer pump 36. The pressure regulator 230 regulates the upstream pressure so that it increases with pump speed. For example, the transfer pressure is regulated to increase from 40 psi at engine idle to 150 psi at maximum RPM.

Thus, the entire output of the transfer pump 36 is conducted to the end chamber 118. The excess fuel delivered to the end chamber 118 (i.e., excluding fuel delivered to the outlet lines 78 and fuel leakage to the housing cavity) is conducted to the annulus 200 and then to the return line 220. The excess fuel aids in cooling the outer end of the rotor 104 and then the central portion of the rotor 104 encircled by the annulus 200. The end chamber 118 completely surrounds and is defined in part by the axial end face and outer annular surface of the rotor 104 to improve rotor cooling. An annular thrust washer or retainer 236 used for accurately positioning the rotor 104 is also cooled by the end chamber fuel. The fuel spilled into the end chamber 118 is carried away from the end chamber 118 by the excess fuel so that the hot spilled fuel is not resupplied to the charge pump 10.

Accordingly, the end fuel chamber 118 and annular fuel chamber 200 provide thermal accumulators and heat sinks for preventing thermal shock to the rotor 104. The capacity of the transfer pump 36 is established to provide continuous flow through the end chamber 118 and annulus 200 for controlling and regulating the temperature of the rotor 104 particularly at high engine RPM when such temperature control is most needed.

Two accumulators 240, 242, connected to the end chamber 118, help compensate for fuel inertia, particularly at high RPM, to maintain a more even fuel pressure in the end chamber 118. Each accumulator 240, 242 comprises a spring biased piston mounted in an axial bore in the distributor head barrel 110. Each accumulator 240, 242 has a coil compression spring 246 or 247 mounted between the accumulator piston and a fixed spring seat. The spring seat has a central opening for connecting the spring chamber to the pump housing cavity. The housing cavity is connected to the transfer pump inlet 221 via a pressure regulator 248 which maintains the housing cavity pressure at approximately 10 psi. The housing cavity is also connected via a conventional vent wire return (not shown) to the fuel tank.

One accumulator 240 serves as a charge accumulator and has a relatively weak spring 246 with a spring rate of 100 pounds/inch and no preload. The other accumulator 242 serves as a spill accumulator and has a relatively strong spring 247 with a spring rate of 350 pounds/inch and a preload of 5 pounds. The charge accumulator 240 is designed to maintain the end chamber pressure sufficiently high during each intake stroke to assure an adequate supply of fuel to the charge pump 10 at high RPM. The charge accumulator 240 normally remains full at low RPM. The spill accumulator 242 is designed to keep the end chamber pressure sufficiently low during the spill phase of each pumping stroke as fuel is spilled into the end chamber 118. The spill accumulator 242 accumulates the spilled fuel to reduce the back pressure spikes in the end chamber 118. The back pressure into which the fuel is spilled is thereby maintained sufficiently low to ensure rapid spill termination of each fuel injection event.

Figure 9:
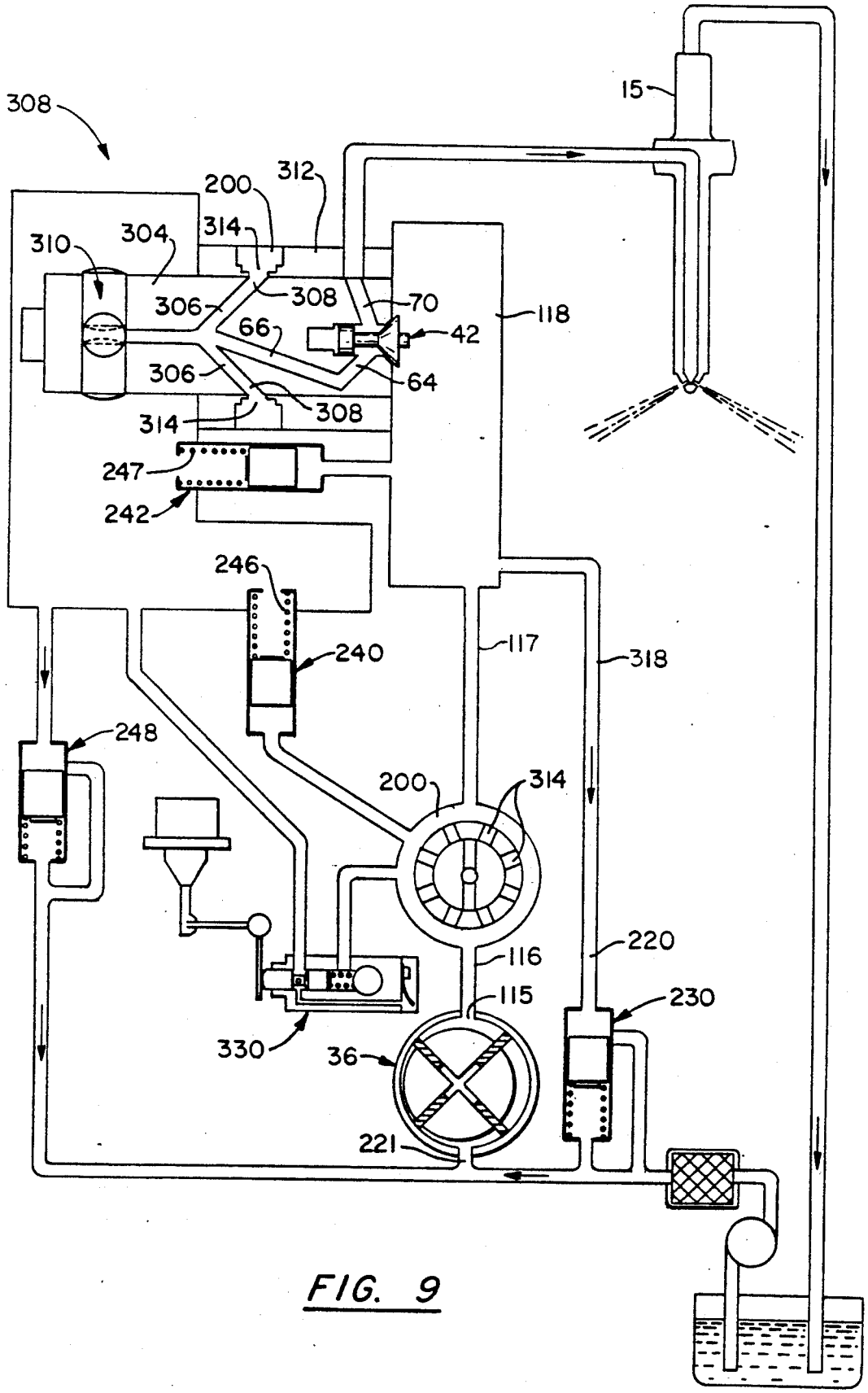
FIG. 9 is a diagrammatic illustration, similar to FIG. 1, of a rotary distributor fuel injection pump incorporating a second embodiment of a fuel system of the present invention.

A modified pump 308, diagrammatically shown in FIG. 9, may be identical to pump 8 except as hereafter described. The modified pump 308 is designed for use with an eight cylinder engine. Thus, the cam ring of the pump 308 has eight equiangularly spaced cam lobes for eight engine injectors 15. The pump rotor 304 has two fuel inlet passages 306, providing diametrically opposed inlet ports 308, for supplying fuel to the charge pump 310 during each intake stroke. The rotor support sleeve 312 is formed with eight equiangularly spaced, radial supply ports 314 connected to the sleeve annulus 200. The two rotor inlet ports 308 register with two of the supply ports 314 to fill the charge pump 310 during each intake stroke. Thus, the sleeve annulus 200 serves to supply fuel to the charge pump 310 as well as to provide an annular cooling chamber for conducting heat from approximately the middle of the hydraulic head 106. The control valve 30 does not regulate the supply of fuel to the charge pump 10 as in pump 8. Instead, the control valve 30 only regulates the injected fuel quantity in a pump-spill mode of operation.

Figure 5:
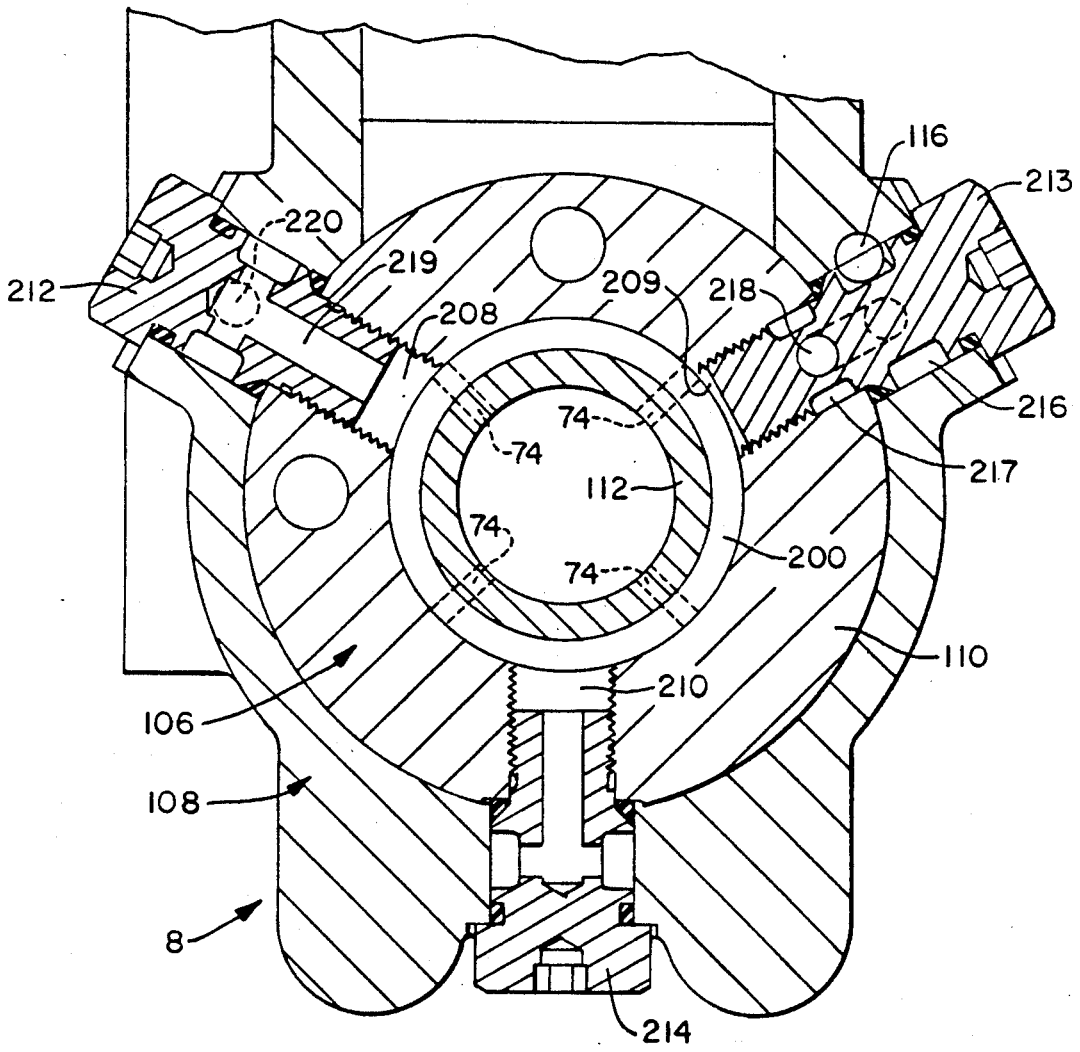
FIG. 5 is a transverse section view, partly broken away and partly in section, of the fuel injection pump.

In pump 308, the charge accumulator 240 is connected directly to the sleeve annulus 200 to maintain the annulus pressure sufficiently high during each intake stroke to ensure an adequate supply of fuel to the charge pump 310 at high RPM as previously described with respect to pump 8. The transfer pump outlet line 116 is connected to the annulus 200 and the annulus 200 is connected to the end chamber 118. This is accommodated by installing suitable connector plugs (like plugs 212–214) in the three radial bores 208–210 (FIG. 5). Also, the drilled passage 117 in the hydraulic head 106 is angularly aligned with a different connector plug to connect the annulus 200 to the end chamber 118. A separate passage 318 is drilled in the hydraulic head 106 to conduct fuel from the end chamber 118 to the return line 220. The pressure regulator 230 is connected to the return line 220 as in pump 8. Thus, in the modified pump 308, the annulus 200 and end chamber 118 are connected in series between the transfer pump outlet 115 and return line 220 in the opposite order in which they are connected in series in pump 8.

In pump 308, the cam ring is angularly adjusted to vary the charge pump stroke timing. The cam ring is hydraulically positioned by a suitable timing control system 330 of the type disclosed in U.S. Pat. No. 4,476,837. A suitable connector plug (like plug 214) connects the sleeve annulus 200 to the timing control system 330.

Thus, in the modified pump 308, the entire output of the transfer pump 36 is conducted to the annulus 200. The excess fuel delivered to the annulus 200 (i.e., excluding fuel delivered to the charge pump 310 and fuel leakage to the housing cavity) is conducted from the annulus 200 to the end chamber 118. As in pump 8, the excess fuel aids in regulating the temperature of the hydraulic head 106 and the outer end and central portion of the rotor 304. Fuel is spilled into the end chamber 118 by the valve 30 to spill terminate each fuel injection event. The hot spilled fuel is carried away from the end chamber 118 by the excess fuel. The end chamber 118 is connected directly to the return line 220 for returning the excess fuel, including the hot spilled fuel, to the transfer pump inlet 221.

As will be apparent to persons skilled in the art, various modifications, adaptations and variations of the foregoing specific disclosure can be made without departing from the teachings of the present invention.

We claim:

1. In a fuel injection pump having a drive shaft, a pump rotor driven by the drive shaft, reciprocating pumping means with periodic intake and pumping strokes to periodically receive an intake charge of fuel and deliver fuel at high pressure for fuel injection; a distributor head with a plurality of angularly spaced distributor outlets, the pump rotor providing a distributor rotor with a distributor port connected to the pumping means, the distributor rotor being rotatably mounted in the distributor head for sequential registration of the distributor port with the distributor outlets for distributing said high pressure delivery of fuel thereto; a fuel system for supplying fuel to the pumping means, having an end chamber at one end of the pump rotor and a fuel supply pump driven by the drive shaft and having an inlet and outlet, the supply pump outlet being connected to the end chamber for supplying fuel thereto, and a pressure regulator for regulating the fuel pressure in the end chamber; and a control valve connected between the pumping means and the end chamber and selectively opened during the intake strokes to supply fuel to the pumping means from the end chamber and during the pumping strokes to spill fuel from the pumping means into the end chamber to terminate said high pressure delivery of fuel; the improvement wherein the fuel system comprises a fuel return passage connected in series with the end chamber downstream thereof, wherein the pressure regulator is mounted in the return passage for regulating the upstream fuel pressure, including the upstream fuel pressure within the end chamber, and is connected for conducting excess fuel for return to the supply pump inlet, and wherein the supply pump is driven by the drive shaft to supply fuel at a rate exceeding the rate of said high pressure delivery of fuel for fuel injection and to provide excess fuel flow continuously through the end chamber and return passage to the pressure regulator.

2. In a fuel injection pump having reciprocating pumping means with periodic intake and pumping strokes to periodically receive an intake charge of fuel and deliver fuel at high pressure for fuel injection; a fuel distributor having a distributor head with a plurality of angularly spaced distributor outlets and a distributor rotor with a distributor port connected to the pumping means, the distributor rotor being rotatably mounted in the distributor head for sequential registration of the distributor port with the distributor outlets for distributing said high pressure delivery of fuel thereto; a fuel system for supplying fuel to the pumping means, having a first, heat sink fuel chamber for the distributor rotor and a fuel supply pump with an inlet and outlet, the supply pump outlet being connected to said first fuel chamber to supply fuel thereto, and a pressure regulator for regulating the fuel pressure in said first fuel chamber; the improvement wherein the fuel system comprises a fuel return line connected in series with said first fuel chamber downstream thereof, wherein the pressure regulator is mounted in the return line for regulating the upstream fuel pressure and is connected for conducting excess fuel for return to the supply pump inlet, and wherein the supply pump supplies fuel at a rate exceeding the rate of said high pressure delivery of fuel for fuel injection and to provide excess fuel flow continuously through said first fuel chamber and return line to the pressure regulator.

3. A fuel injection pump according to claim 2 wherein said first fuel chamber is an end chamber at one end of the distributor rotor.

4. In a fuel injection pump having reciprocating pumping means with periodic intake and pumping strokes to periodically receive an intake charge of fuel and deliver fuel at high pressure for fuel injection; a fuel distributor having a distributor head with a plurality of angularly spaced distributor outlets and a distributor rotor with a distributor port connected to the pumping means, the distributor rotor being rotatably mounted in the distributor head for sequential registration of the distributor port with the distributor outlets for distributing said high pressure delivery of fuel thereto; a fuel system for supplying fuel to the pumping means, having an end chamber at one end of the distributor rotor and a fuel supply pump with an inlet and outlet, the supply pump outlet being connected to the end chamber for supplying fuel thereto, and a pressure regulator for regulating the fuel pressure in the end chamber; and a control valve connected to the pumping means and selectively opened during the pumping strokes to spill fuel from the pumping means into the end chamber to terminate said high pressure delivery of fuel; the improvement wherein the fuel system comprises an auxiliary passage in the distributor rotor connected to the end chamber and having an auxiliary port trailing the distributor port to register sequentially with the distributor outlets after said high pressure delivery of fuel thereto to reset the pressure in the distributor outlets to approximately the same initial pressure.

5. A fuel injection pump according to claim 4 further comprising a one-way check valve in the auxiliary passage providing free flow of fuel in one direction from the end chamber to the auxiliary port and limited back flow in the opposite direction to the end chamber.

6. A fuel injection pump according to claim 5 wherein the control valve is an electrically operated valve and further comprising an electrical control unit connected to the control valve for electrically governing the opening and closure of the control valve, the electrical control unit, in an air purging mode thereof, automatically maintaining the control valve closed at the end of each pumping stroke until after the distributor port moves out of registry with the distributor outlet to prevent back flow from the distributor outlet to the end chamber.

7. A fuel injection pump according to claim 5 wherein the auxiliary passage includes a radial bore and wherein the check valve is a ball check valve having a ball mounted in the outer end of the radial bore and urged radially outwardly to an open position thereof by centrifugal force during rotation of the distributor rotor.

8. In a fuel injection pump having reciprocating pumping means with periodic intake and pumping strokes to periodically receive an intake charge of fuel and deliver fuel at high pressure for fuel injection; a fuel distributor having a distributor head with a plurality of angularly spaced distributor outlets and a distributor rotor with a distributor port connected to the pumping means, the distributor rotor being rotatably mounted in the distributor head for sequential registration of the distributor port with the distributor outlets for distributing said high pressure delivery of fuel thereto; a fuel system for supplying fuel to the pumping means, having an end chamber at one end of the distributor rotor and a fuel supply pump with an inlet and outlet, the supply pump outlet being connected to the end chamber for supplying fuel thereto, and a pressure regulator for regulating the fuel pressure in the end chamber; and a control valve connected to the pumping means and selectively opened during the pumping strokes to spill fuel from the pumping means into the end chamber to terminate said high pressure delivery of fuel; the improvement wherein the control valve comprises a coaxial valve bore in the rotor, a valve member axially shiftable in the valve bore between open and closed axial positions thereof, the valve member having a peripheral annulus connecting the pumping means to the end chamber in the open position of the valve member and connecting the distributor port to the pumping means in both the open and closed positions of the valve member.

9. A fuel injection pump according to claim 8 wherein the rotor has a first internal passage extending between the annulus and pumping means and a second internal distributor passage extending between the annulus and distributor port.

10. In a fuel injection pump having reciprocating pumping means with periodic intake and pumping strokes to periodically receive an intake charge of fuel and deliver fuel at high pressure for fuel injection; a fuel distributor having a distributor head with a plurality of angularly spaced distributor outlets and a distributor rotor with a distributor port connected to the pumping means, the distributor rotor being rotatably mounted in the distributor head for sequential registration of the distributor port with the distributor outlets for distributing said high pressure delivery of fuel thereto; a fuel system for supplying fuel to the pumping means, having an end chamber at one end of the distributor rotor and a fuel supply pump with an inlet and outlet, the supply pump outlet being connected to the end chamber for supplying fuel thereto, and a pressure regulator for regulating the fuel pressure in the end chamber; and a control valve connected to the pumping means and selectively opened during the pumping strokes to spill fuel from the pumping means into the end chamber to terminate said high pressure delivery of fuel; the improvement wherein the fuel system comprises a shuttle retraction valve in each distributor outlet having a retraction shuttle axially shiftable through an intermediate closed position thereof between fully closed and fully open limit positions thereof establishing the maximum shuttle stroke, the retraction shuttle being mounted with the upstream and downstream fuel pressures at opposite ends thereof biasing the retraction shuttle in its opening and closing directions respectively, closure spring means biasing the retraction shuttle in its closing direction while the shuttle is between its said fully open and intermediate positions only, the retraction shuttle freely floating in an unloaded spring gap between its said intermediate and fully closed positions to equalize the upstream and downstream fuel pressures at the opposite ends thereof.

11. A fuel injection pump according to claim 10 wherein the closure spring means is a short coil compression spring which is fully unloaded at said intermediate position of the retraction shuttle.

12. A fuel injection pump according to claim 10 wherein said unloaded spring gap between the intermediate and closed positions of the retraction shuttle is at least approximately one-half the maximum shuttle stroke.

13. In a fuel injection pump having reciprocating pumping means with periodic intake and pumping strokes to periodically receive an intake charge of fuel and deliver fuel at high pressure for fuel injection; a fuel distributor having a distributor head with a plurality of angularly spaced distributor outlets and a distributor rotor with a distributor port connected to the pumping means, the distributor rotor being rotatably mounted in the distributor head for sequential registration of the distributor port with the distributor outlets for distributing said high pressure delivery of fuel thereto; a fuel system for supplying fuel to the pumping means, having an end chamber at one end of the distributor rotor and a fuel supply pump with an inlet and outlet, the supply pump outlet being connected to the end chamber for supplying fuel thereto, and a pressure regulator for regulating the fuel pressure in the end chamber; and a control valve connected to the pumping means and selectively opened during the pumping strokes to spill fuel from the pumping means into the end chamber to terminate said high pressure delivery of fuel; the improvement wherein the fuel system comprises a fuel return line connected in series with the end chamber downstream thereof, wherein the pressure regulator is mounted in the return line for regulating the upstream fuel pressure and is connected for conducting excess fuel for return to the supply pump inlet, wherein the supply pump supplies fuel at a rate exceeding the rate of said high pressure delivery of fuel for fuel injection and to provide excess fuel flow continuously through the end chamber and return line to the pressure regulator, and wherein the fuel distributor comprises an auxiliary passage in the distributor rotor connected to the end chamber and having an auxiliary port trailing the distributor port to register sequentially with the distributor outlets after said high pressure delivery of fuel thereto to reset the pressure in the distributor outlets to approximately the same initial pressure.

14. In a fuel injection pump having reciprocation pumping means with periodic intake and pumping strokes to periodically receive an intake charge of fuel and deliver fuel at high pressure for fuel injection; a fuel distributor having a distributor head with a plurality of angularly spaced distributor outlets and a distributor rotor with a distributor port connected to the pumping means, the distributor rotor being rotatably mounted in the distributor head for sequential registration of the distributor port with the distributor outlets for distributing said high pressure delivery of fuel thereto; a fuel system for supplying fuel to the pumping means, having an end chamber at one end of the distributor rotor and a fuel supply pump with an inlet and an outlet, the supply pump outlet being connected to the end chamber for supplying fuel thereto, and a pressure regulator for regulating the fuel pressure in the end chamber; and a control valve connected to the pumping means and selectively opened during the pumping strokes to spill fuel from the pumping means into the end chamber to terminate said high pressure delivery of fuel; the improvement wherein the fuel system comprises a fuel return line connected in series with the end chamber downstream thereof, wherein the pressure regulator is mounted in the return line for regulating the upstream fuel pressure and is connected for conducting excess fuel for return to the supply pump inlet, wherein the supply pump supplies fuel at a rate exceeding the rate of said high pressure delivery of fuel for fuel injection and to provide excess fuel flow continuously through the end chamber and return line to the pressure regulator, wherein the control valve is selectively opened during the intake strokes for supplying said intake charges of fuel to the pumping means from the end chamber and wherein the fuel system further comprises charge and spill accumulators connected to the end chamber to respectively maintain adequate fuel pressure in the end chamber for supplying fuel to the pumping means during the intake strokes and reduce the back pressure in the end chamber as fuel is spilled into the end chamber during the pumping strokes.

15. In a fuel injection pump having reciprocating pumping means with periodic intake and pumping strokes to periodically receive an intake charge of fuel and deliver fuel at high pressure for fuel injection; a fuel distributor having a distributor head with a plurality of angularly spaced distributor outlets and a distributor rotor with a distributor port connected to the pumping means, the distributor rotor being rotatably mounted in the distributor head for sequential registration of the distributor port with the distributor outlets for distributing said high pressure delivery of fuel thereto; a fuel system for supplying fuel to the pumping means, having an end chamber at one end of the distributor rotor and a fuel supply pump with an inlet and outlet, the supply pump outlet being connected to the end chamber for supplying fuel thereto, and a pressure regulator for regulating the fuel pressure in the end chamber; and a control valve connected to the pumping means and selectively opened during the pumping strokes to spill fuel from the pumping means into the end chamber to terminate said high pressure delivery of fuel; the improvement wherein the fuel system comprises a fuel return line connected in series with the end chamber downstream thereof, wherein the pressure regulator is mounted in the return line for regulating the upstream fuel pressure and is connected for conducting excess fuel for return to the supply pump inlet, wherein the supply pump supplies fuel at a rate exceeding the rate of said high pressure delivery of fuel for fuel injection and to provide excess fuel flow continuously through the end chamber and return line to the pressure regulator, and wherein the fuel system further comprises a spill accumulator connected directly to the end chamber to reduce the back pressure in the end chamber as fuel is spilled into the end chamber during the pumping strokes.

16. In a fuel injection pump having reciprocating pumping means with periodic intake and pumping strokes to periodically receive an intake charge of fuel and deliver fuel at high pressure for fuel injection; a fuel distributor having a distributor head with a plurality of angularly spaced distributor outlets and a distributor rotor with a distributor port connected to the pumping means, the distributor rotor being rotatably mounted in the distributor head for sequential registration of the distributor port with the distributor outlets for distributing said high pressure delivery of fuel thereto; a fuel system for supplying fuel to the pumping means, having an end chamber at one end of the distributor rotor and a fuel supply pump with an inlet and outlet, the supply pump outlet being connected to the end chamber for supplying fuel thereto, and a pressure regulator for regulating the fuel pressure in the end chamber; and a control valve connected to the pumping means and selectively opened during the pumping strokes to spill fuel from the pumping means into the end chamber to terminate said high pressure delivery of fuel; the improvement wherein the fuel system comprises a fuel return line connected in series with the end chamber downstream thereof, wherein the pressure regulator is mounted in the return line for regulating the upstream fuel pressure and is connected for conducting excess fuel for return to the supply pump inlet, wherein the supply pump supplies fuel at a rate exceeding the rate of said high pressure delivery of fuel for fuel injection and to provide excess fuel flow continuously through the end chamber and return line to the pressure regulator, wherein the fuel system comprises an annular fuel chamber in the distributor head surrounding the distributor rotor and connected in series with the end chamber and between the supply pump outlet and return line, and wherein the fuel system further comprises a plurality of angularly spaced connecting plug bores extending radially outwardly from the annular chamber, a first connector plug in a first plug bore connecting the supply pump outlet to one of said chambers and a second connector plug in a second plug bore connecting the other of said chamber in part between said one chamber and the return line.

17. In a fuel injection pump having reciprocably pumping means with periodic intake and pumping strokes to periodically receive an intake charge of fuel and deliver fuel at high pressure for fuel injection; a fuel distributor having a distributor head with a plurality of angularly spaced distributor outlets and a distributor rotor with a distributor port connected to the pumping means, the distributor rotor being rotatably mounted in the distributor head for sequential registration of the distributor port with the distributor outlets for distributing said high pressure delivery of fuel thereto; a fuel system for supplying fuel to the pumping means, having an end chamber at one end of the distributor rotor and fuel supply pump with an inlet and outlet, the supply pump outlet being connected to the end chamber for supplying fuel thereto, and a pressure regulator for regulating the fuel pressure in the end chamber; and a control valve connected to the pumping means and selectively opened during the pumping strokes to spill fuel from the pumping means into the end chamber to terminate said high pressure delivery of fuel; the improvement wherein the fuel system comprises a fuel return line connected in series with the end chamber downstream thereof, wherein the pressure regulator is mounted in the return line for regulating the upstream fuel pressure and is connected for conducting excess fuel for return to the supply pump inlet, wherein the supply pump supplies fuel at a rate exceeding the rate of said high pressure delivery of fuel for fuel injection and to provide excess fuel flow continuously through the end chamber and return line to the pressure regulator, and wherein the control valve comprises a coaxial valve bore in the rotor, a valve member axially shiftable in the valve bore between open and closed axial positions thereof, the valve member having a peripheral annulus connecting the pumping means to the end chamber in the open position of the valve member and connecting the distributor port to the pumping means in both the open and closed positions of the valve member.

18. A fuel injection pump according to claim 1 wherein the pressure regulator is connected to conduct the excess fuel directly to the supply pump inlet.

19. A fuel injection pump according to claim 1 wherein the fuel system comprises an annular fuel chamber in the distributor head surrounding the distributor rotor and connected in series with the end chamber and between the supply pump outlet and return passage.

20. A fuel injection pump according to claim 19 wherein the annular chamber is connected between the end chamber and return passage and wherein the control valve is selectively opened during the intake strokes to supply said intake charges of fuel to the pumping means from the end chamber.

21. A fuel injection pump according to claim 19 wherein the annular chamber is connected between the supply pump outlet and end chamber and further comprising inlet port means in the fuel distributor for supplying said intake charges of fuel to the pumping means from the annular chamber.

22. A fuel injection pump according to claim 1 wherein the control valve comprises a coaxial valve bore in the distributor rotor and a valve member axially shiftable in the valve bore between closed and open axial positions thereof and selectively axially shifted to its open position during the pumping strokes to spill fuel from the pumping means into the end chamber to terminate said high pressure delivery of fuel.

23. A fuel injection pump according to claim 13 further comprising a one-way check valve in the auxiliary passage providing free flow of fuel in one direction from the end chamber to the auxiliary port and limited back flow in the opposite direction to the end chamber.

24. A fuel injection pump according to claim 23 wherein the control valve is an electrically operated valve and further comprising an electrical control unit connected to the control valve for electrically governing the opening and closure of the control valve, the electrical control unit, in an air purging mode thereof, automatically maintaining the control valve closed at the end of each pumping stroke until after the distributor port moves out of registry with the distributor outlet to prevent back flow from the distributor outlet to the end chamber.

25. A fuel injection pump according to claim 23 wherein the auxiliary passage includes a radial bore and wherein the check valve is a ball check valve having a ball mounted in the outer end of the radial bore and urged radially outwardly to an open position thereof by centrifugal force during rotation of the distributor rotor.

26. A fuel injection pump according to claim 1 wherein the fuel system further comprises a charge accumulator to maintain adequate fuel pressure for supplying fuel to the pumping means during the intake strokes.

27. A fuel injection pump according to claim 16 wherein said one chamber is the end chamber.

28. A fuel injection pump according to claim 17 wherein the rotor has a first internal passage extending between the annulus and pumping means and a second internal distributor passage extending between the annulus and distributor port.

29. A fuel injection pump according to claim 1 further comprising a shuttle retraction valve in each distributor outlet having a retraction shuttle axially shiftable through an intermediate closed position thereof between fully closed and fully open limit positions thereof establishing the maximum shuttle stroke, the retraction shuttle being mounted with the upstream and downstream fuel pressures at opposite ends thereof biasing the retraction shuttle in its opening and closing direction respectively, closure spring means biasing the retraction shuttle in its closing direction while the shuttle is between its said fully open and intermediate positions only, the retraction shuttle freely floating in an unloaded spring gap between its said intermediate and fully closed positions to equalize the upstream and downstream fuel pressures at the opposite ends thereof.

30. A fuel injection pump according to claim 29 wherein the closure spring means is a short coil compression spring which is fully unloaded at said intermediate position of the retraction shuttle.

31. A fuel injection pump according to claim 29 wherein said unloaded spring gap between the intermediate and closed positions of the retraction shuttle is at least approximately one-half the maximum shuttle stroke.

* * * * *